US006012529A

United States Patent [19]

Mikolajczyk et al.

[11] Patent Number: 6,012,529

[45] Date of Patent: Jan. 11, 2000

[54] DOWNHOLE GUIDE MEMBER FOR MULTIPLE CASING STRINGS

[76] Inventors: Raymond F. Mikolajczyk, 1031-B Pierre Washington Rd., Broussard, La. 70518; Michael R. Mikolajczyk, 108 Warwicke Dr., Lafayette, La. 70508

[21] Appl. No.: 09/102,480

[22] Filed: Jun. 22, 1998

[51] Int. Cl.[7] ..... E21B 7/04; E21B 17/10

[52] U.S. Cl. ..... 166/349; 166/241.6; 175/5

[58] Field of Search ..... 166/241.6, 241.1, 166/241.4, 241.2, 241.5, 241.7, 97.5, 85.5, 349, 366, 89.2, 313; 175/5

[56] References Cited

U.S. PATENT DOCUMENTS

| | | | |
|---|---|---|---|
| 3,108,639 | 10/1963 | Brooks | 166/241 |
| 3,276,522 | 10/1966 | Jay | 166/173 |
| 4,478,278 | 10/1984 | Klein | 166/105 |
| 4,483,395 | 11/1984 | Kramer et al. | 166/241 |
| 5,377,752 | 1/1995 | Farrara | 166/241.6 |
| 5,458,199 | 10/1995 | Collins et al. | 166/313 |
| 5,560,435 | 10/1996 | Sharp | 175/5 |
| 5,810,086 | 9/1988 | Bridges | 166/349 |
| 5,918,675 | 7/1999 | Borak, Jr. et al. | 166/349 |

*Primary Examiner*—Hoang Dang
*Attorney, Agent, or Firm*—Jesse D. Lambert

[57] ABSTRACT

A downhole casing guide member comprising a structure having a unitary formation wherein in a plane perpendicular to a center longitudinal axis of the structure, the unitary formation is generally "Y" shaped in two opposite directions about the center longitudinal axis. The downhole casing guide member further comprises at least one clamping bracket member securable to the structure. The unitary formation of the structure serves to maximize available flow area for flow of fluid, liquid slurry and/or cement around the contour of the unitary formation and maximize the diameters of casing strings which may be run within a conductor casing; and tapered upper and lower shoulders on the casing guide member ease passage of the guide member into and out of a conductor casing. Further, the overall configuration and shape of the downhole guide member eases passage of casing strings lowered into or removed from the conduits formed by the guide member.

21 Claims, 7 Drawing Sheets

DOWNHOLE GUIDE MEMBER FOR MULTIPLE CASING STRINGS

BACKGROUND OF THE INVENTION

1. Field of the Invention

The present invention relates to downhole guide members employed in subterranean boreholes, typically drilled for oil and gas wells. More particularly, the invention relates to a downhole casing guide member comprising a uniquely contoured structure which guides multiple casing strings downhole and maintains such multiple casing strings in substantially fixed, side-by-side relationship with one another downhole within a conductor casing. The contour of the structure maximizes available cross sectional fluid flow area in a conductor casing, in a plane perpendicular to the center longitudinal axis of the conductor casing, to minimize fluid pressure losses when flowing fluids such as drilling fluids or cement slurries around the structure. Moreover, the contour of such structure, in the plane perpendicular to the longitudinal axis of the conductor casing, maximizes the diameter of the casing strings which may be run within a given conductor casing diameter by forming two bores, spaced substantially 180° apart, where a portion of each bore is formed by a portion of the inner wall of the conductor casing. Additionally, the contour of the structure presents tapered upper and lower shoulders which ease insertion into and removal from the conductor casing.

2. General Background

In the development of certain oil and gas fields, it is at times highly desirable to drill multiple, directionally drilled wellbores from a common surface location inside a single large "conductor casing" string. This is especially so in certain offshore oil and gas developments. In the following description, the term "conductor casing" refers generally to the initial, generally large diameter casing string installed, through which multiple wells may be drilled. Conductor casing is typically driven, drilled, or jetted into place so that the lowermost end (the "shoe") is several hundred feet below the mudline.

After the conductor casing is in place, individual wellbores are drilled and the initial casing string of each individual well is run and cemented in place. In this description, the initial casing string for each individual well is referred to as "surface casing ". Although the process and present invention are described in terms of two surface casing strings run within a conductor casing, it is understood that the invention is not limited to arrangements comprising two surface casing strings and in fact comprises different numbers of surface casing strings. Typical arrangements employ two 13-⅜" surface casing strings run substantially side-by-side within a 36" conductor casing, although other combinations of conductor and surface casing diameters may be used and are within the scope of the present invention.

A typical sequence of operations is as follows: a 36" conductor string is driven into the earth so that the casing shoe is several hundred feet below the mudline, or ocean floor. As water depths may be several hundred feet, the total length of conductor casing may be on the order of 1000'. A large diameter drill bit, typically approaching the inner diameter of the conductor casing, is then used to drill out the conductor casing to a depth slightly beyond the conductor casing shoe. Thereafter, a sequence of installation of a downhole casing guide member in the conductor casing, drilling of surface casing holes, and running and cementing of two surface casing strings follows. The operations may vary depending upon the type of guide member used.

Drilling, formation evaluation, running of additional casing strings, etc., in each borehole, then proceeds in generally conventional manner through each surface casing string.

It is important for the two surface casing strings to be held downhole in fixed, side-by-side spacing with respect to one another, and the downhole casing guide members serve this purpose. Fluid flow past the downhole casing guide members is necessary for passage of drilling fluids (commonly called "mud") and cement slurries during the drilling of the surface holes and the running and cementing of the surface casing strings. It is desirable, then, that the downhole casing guide member retain the surface casing strings in fixed side-by-side position while permitting use of the largest possible surface casing strings within a given conductor casing, and while occupying as little as possible of the available cross sectional fluid flow area within the conductor casing, thereby preserving relatively uninhibited fluid flow past the guide member. Further, as the guide member must be run into (and at times retrieved from) the conductor casing, a profile which minimizes "hanging up" on ledges, obstructions and the like is desired.

One such structure is described in U.S. Pat. No. 5,560,435, to Sharp, entitled "Method and Apparatus for Drilling Multiple Offshore Wells from Within a Single Conductor String." The invention, by Sharp, discloses a method of drilling multiple wells in a conductor casing string. The invention, by Sharp, uses a downhole drilling guide which is a cylindrical member having two opposing flat, planar surfaces, and includes multiple guide bores in a side-by-side, parallel alignment, for receiving a casing string in each guide bore. The guide member is installed by running it downhole on one surface casing string (secured on a releasable connector) until the guide member rests on an internal shoulder in the conductor casing. Surface casing strings are then run through the guide bores. The configuration of the guide member of Sharp results in little available flow area in the conductor casing when the guide member and surface casing strings are in place. Use of only a single guide member as taught by Sharp may make it difficult to properly guide the second surface casing string through the guide bore. In addition, the relatively abrupt shoulders of the Sharp apparatus would tend to "hang up" on ledges, obstructions and the like within the conductor casing string.

Another such structure is described in U.S. Pat. No. 5,458,199, to Collins et al., entitled "Assembly and Process for Drilling and Completing Multiple Wells." The invention, by Collins et al., uses a downhole tie-back assembly to maintain the casing strings separated while downhole. The downhole tie-back assembly comprises bores for running the casing strings therethrough. In one embodiment, a first casing string is is threaded into screw threads in the first bore, and the first casing string is used to lower the tie-back assembly into place. A collet latch is attached to the exterior of the second casing string, and that collet latch snaps into a mating profile in the second bore, thus connecting the second casing string to the tie-back assembly. Relatively little flow area remains in the conductor casing with installation of the tie-back assembly and the two casing strings. Additionally, the maximum size of casing strings that may be run within the conductor casing is reduced due to the tie-back assembly bores completely encompassing the casing strings, and the relatively abrupt shoulders of the Collins et al assembly may result in hang-ups on interior ledges, etc. in the conductor casing during running.

As can be appreciated, the known downhole casing guide member structure and tie-back assemblies require at least one of the surface casing strings to be latched or secured to the downhole guide member and tie-back assembly to lower such downhole guide member downhole. In effect, one of the surface casing strings serves as the "running string" for the downhole guide member. Moreover, once both casing strings are installed in the downhole guide members of known design, the remaining fluid flow area around the downhole guide member and/or tie-back assembly and the first and second surface casing strings is insufficient for easy flow of displaced drilling fluids and/or cement slurries around the downhole guide member and/or tie-back assembly. Although the maximum diameter of casing strings that may be run within a conductor is (in the case of two casing strings) fundamentally limited to one-half of the inner diameter of the conductor, with the downhole casing guide members of known design the maximum outer diameter of the two casing strings is further limited by the bores in the downhole guide member being completely contained within the diameter of the downhole guide member. The abrupt upper and lower shoulders on the downhole guide members of known design do not permit easy passage past ledges or obstructions in the conductor casing.

SUMMARY OF THE PRESENT INVENTION

The preferred embodiment of the apparatus of the present invention solves the aforementioned problems in a straight forward and simple manner. In the preferred embodiment, the present invention comprises a downhole casing guide member comprising a uniquely contoured structure which:

- guides two surface casing strings downhole and maintains such two surface casing strings in substantially fixed, side-by-side spaced relation in the conductor casing;
- has a contour which maximizes the available fluid flow area, after installation of the downhole guide member and casing strings, in a plane perpendicular to the center axis of the conductor casing;
- has a contour, in a plane perpendicular to the center axis of the conductor casing, which maximizes the outer diameter of the surface casing strings which may be run downhole within a given diameter of conductor casing, by forming two bores, spaced substantially 180° apart, wherein a portion of each bore is formed from a portion of the inner wall of the conductor casing;
- is adapted to be run and deployed downhole in a conductor casing on at least one running string, independently from any casing string; and
- has tapered upper and lower entry surfaces or shoulders which ease passage of the downhole guide member within the conductor casing.

The downhole casing guide member of the present invention comprises a structure having a center longitudinal axis substantially coincident with the center longitudinal axis of the conductor casing, wherein the formation of such structure in a plane perpendicular to such center axis is generally "Y" shaped in two opposite directions about the center longitudinal axis of the structure. In other words, the formation of such structure in a plane perpendicular to such center longitudinal axis is generally "Y" shaped in a first direction and generally "Y" shaped in a second direction offset 180° from said first direction.

In view of the above, it is an object of the present invention to provide a downhole casing guide member comprising a structure having a center spacing member elongated in the plane perpendicular to the longitudinal axis of the conductor casing; a first pair of radial leg support members wherein each radial leg support member of the first pair flares radially angularly in different directions from one end of the elongated center spacing member; and a second pair of radial leg support members wherein each radial leg support member of the second pair flares radially angularly in different directions from the other end of the elongated center spacing member. The gaps between the two radial leg support members of the first and second pairs form first and second passages, respectively, for fluid flow therethrough.

Another object of the present invention is to provide a structure with first and second cavities which have axes parallel to the center longitudinal axis of the conductor casing. The first and second cavities extend into the first and second passages, respectively, for passage therethrough of first and second tubular members or "running strings" wherein the tubular members are clamped in their respective cavities with respective clamping bracket members. At least one of the first and second tubular members is required to lower the downhole casing guide member downhole in the conductor casing to a predetermined depth.

A further object of the present invention is to provide such a downhole casing guide member which is capable of being lowered downhole via at least one tubular member running string clamped thereto. Therefore the use of the surface casing string for lowering the downhole casing guide member is eliminated and the surface casing string need not be secured to the downhole casing guide member.

It is a still further object of the present invention to provide the uniquely contoured structure with two trough-shaped conduits, each spaced substantially 180° apart, thereby forming two bores for guiding in each bore a respective casing string downhole and maintaining each such respective casing string in substantially fixed spaced relation with respect to the other downhole in the conductor casing. One of the trough-shaped conduits is formed by a first concaved surface connecting the distal end of the first radial leg support member of the first pair and the distal end of the first radial leg support member of the second pair. The other trough-shaped conduit is formed by a second concaved surface connecting the distal end of the second radial leg support member of the first pair and the distal end of the second radial leg support member of the second pair. The first bore, for guiding therein a first surface casing string, is defined by the trough-shaped conduit and the curvature of the interior surface of the conductor casing between the first radial leg support member of the first pair and the first radial leg support member of the second pair. The second bore, for guiding therein a second surface casing string, is defined by the trough-shaped conduit and the interior surface of the conductor casing between the second radial leg support member of the first pair and the second radial leg support member of the second pair.

It is a still further object of the present invention to provide two bores which have a distorted circular outline to provide passageways on each side of a surface casing string when run in its respective bore wherein such passageways allow drilling fluids and/or cement slurries to flow along the side of the surface casing strings within the bore of the conductor casing.

It is a still further object of the present invention to provide such a downhole casing guide member which allows the diameter of the two surface casing strings which may be run within a conductor casing to be maximized.

It is a further object of the present invention to provide a downhole casing guide member which has a top surface and a bottom surface parallel to the top surface wherein the top surface and the bottom surface have beveled ends in close proximity to the outer perimeter thereof, for enhancing passage of the downhole casing guide member into and out of the conductor casing. More specifically, at least a portion of the top and bottom surfaces of each of the radial leg support members of the first and second pairs are beveled.

In view of the above objects it is a feature of the present invention to provide a downhole casing guide member which generally includes a uniquely contoured unitary structure and two clamping support bracket members capable of being secured to such structure.

It is another feature of the present invention to provide a downhole casing guide member which is structurally relatively simple.

It is a further feature of the present invention to provide a downhole casing guide member which is relatively inexpensive to manufacture, and which may be formed in a unitary design, such as by casting or molding.

The above and other objects and features of the present invention will become apparent from the drawings, the description given herein, and the appended claims.

BRIEF DESCRIPTION OF THE DRAWINGS

For a further understanding of the nature and objects of the present invention, reference should be had to the following description in conjunction with the accompanying drawings in which like parts are given like reference numerals.

DETAILED DESCRIPTION OF THE PREFERRED EMBODIMENT

Figure 1:
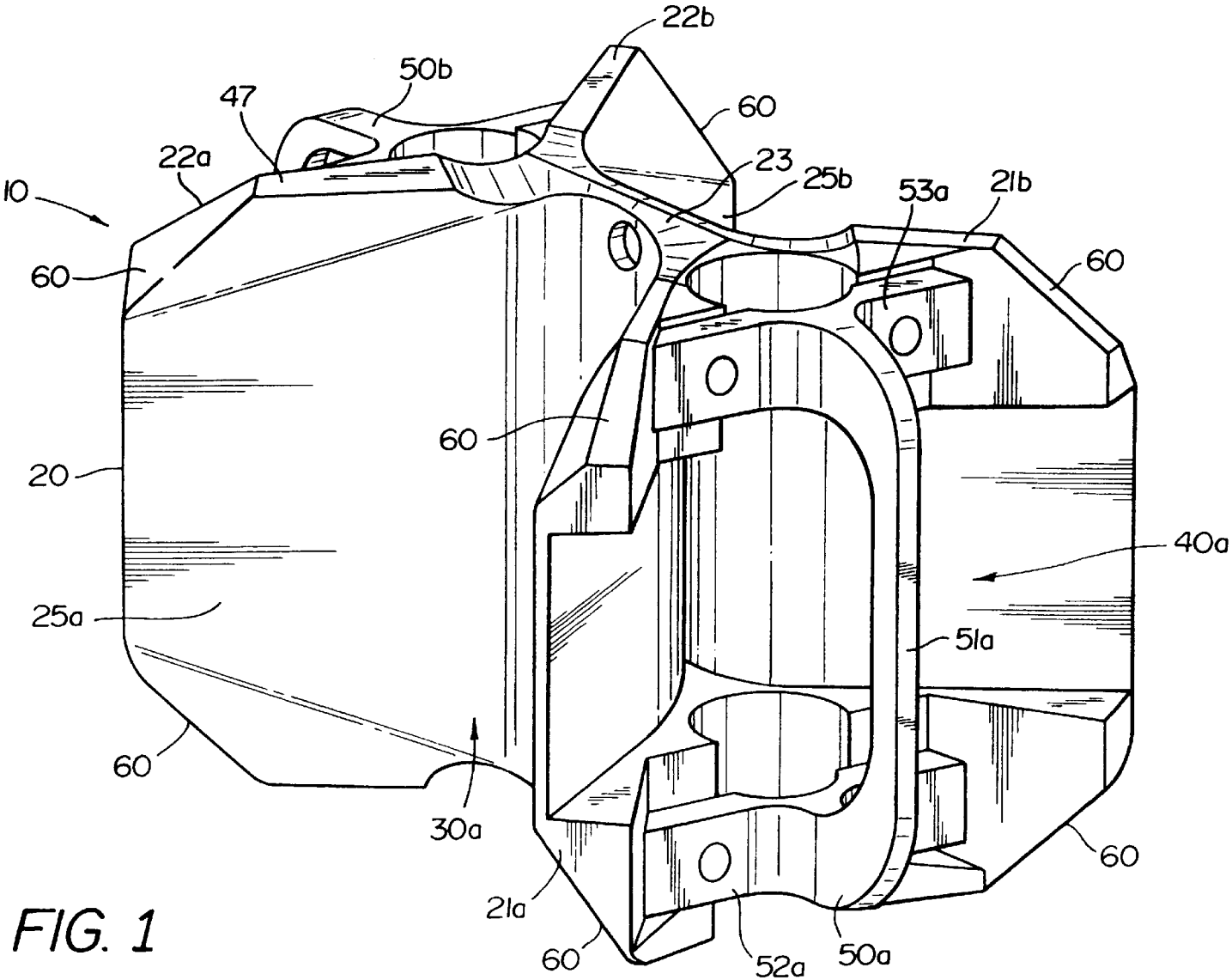
FIG. 1 is a perspective view of the downhole casing guide member of the present invention.

Referring now to the drawings, and in particular FIGS. 1–7, the downhole casing guide member of the present invention is designated generally by the numeral 10. Certain of the drawings omit certain of the reference numerals for clarity. Downhole casing guide member 10 is generally comprised of structure 20 and first and second clamping bracket members 50*a* and 50*b*.

Structure 20 has a unitary formation bounded by the inner diameter of conductor casing 5. The unitary formation should provide for a sufficient annular clearance to allow downhole casing guide member 10 to fit within the inner diameter of conductor casing 5 and be lowered to a desired depth in conductor casing 5, as will be herein described. In the exemplary embodiment, downhole casing guide member 10 is bounded radially by radius R1, and is lowered in conductor casing 5 which has an inner radius slightly greater than radius R1. Downhole casing guide member 10 may be dimensioned to fit in any size conductor casing 5.

Structure 20 has center longitudinal axis 8 parallel to the center longitudinal axis of conductor casing 5. The unitary formation of structure 20 in a plane perpendicular to center axis 8 is generally "Y" shaped in two opposite directions about center longitudinal axis 8. In other words, the unitary formation of structure 20 in a plane perpendicular to center longitudinal axis 8 is generally "Y" shaped in a first direction and generally "Y" shaped in a second direction, where the second direction is offset 180° from the first direction. With downhole casing guide member 10 in place in conductor casing 5, the interior area of conductor casing 5 is substantially divided into two halves.

As can be readily seen, the unitary formation of structure 20 significantly reduces the cross sectional area of structure 20 occupying the interior of conductor casing 5, thereby maximizing the diameter of casing strings 7*a* and 7*b* (which may be surface casing strings) which can be run inside a given diameter of conductor casing 5. Moreover, the gap between the legs of each "Y" provides a passage for the flow of fluids, such as drilling fluids and/or cement slurries, therethrough.

More specifically, the unitary formation of structure 20 is defined by elongated center spacing member 23 which is elongated in a plane perpendicular to the center longitudinal axis of conductor casing 5; a first pair of radial leg support members 21*a* and 21*b* wherein each radial leg support member flares radially angularly in different directions from one end of elongated center spacing member 23; and a second pair of radial leg support members 22*a* and 22*b* wherein each radial leg support member flares radially angularly in different directions from the other end of elongated center spacing member 23.

The first pair of radial leg support members 21*a* and 21*b* and the second pair of radial leg support members 22*a* and 22*b* serve to center and support elongated center spacing member 23 within conductor casing 5, and additionally serve to section the interior of conductor casing 5. The gap between radial leg support member 21*a* and radial leg support member 21*b* of the first pair forms first passage 40*a*. Similarly, the gap between radial leg support member 22*a* and radial leg support member 22*b* of the second pair forms second passage 40*b*. First passage 40*a* and second passage 40*b* permit fluids, such as drilling fluids and/or cement slurries, to flow therethrough.

Structure 20 has first and second concaved surfaces 25*a* and 25*b*, is circumferentially spaced 180° apart, wherein such concaved surfaces 25*a* and 25*b* are substantially symmetrical about curvature mid points P1 and P2 and are bounded by circumference C. First and second concaved surfaces 25*a* and 25*b* form elongated center spacing member 23; in addition, first concaved surface 25*a* forms the exterior surfaces of radial leg support members 21*a* and 22*a*, and second concaved surface 25*b* forms the exterior surfaces of radial leg support members 21*b* and 22*b*.

First and second concaved surfaces 25*a* and 25*b* form first and second conduits 30*a* and 30*b*, respectively, which are trough-shaped and separated by elongated center spacing member 23. Elongated center spacing member 23 serves to space casing strings 7*a* and 7*b* within conductor casing 5. The distance from curvature mid point P1 of first concaved surface 25*a*, to point P1' on circumference C, is diameter D1. Likewise, the distance from curvature mid point P2 of second concaved surface 25*b*, to point P2' on circumference C, is diameter D2. Point P1' is essentially the mid point of that section of circumference C between radial leg support members 21 a and 22*a*. Point P2' is essentially the mid point of that section of circumference C between radial leg support members 21*b* and 22*b*.

With downhole casing guide member 10 in place within a conductor casing string, trough-shaped conduit 30*a* and the interior surface of conductor casing 5 between radial leg support members 21*a* and 22*a* form a first bore for guiding therethrough casing string 7*a*. Likewise, trough-shaped conduit 30*b* and the interior surface of conductor casing 5 between radial leg support members 21*b* and 22*b* form a second bore for guiding therethrough casing string 7*b*.

More specifically, trough-shaped conduits 30*a* and 30*b* defined by first and second concaved surfaces 25*a* and 25*b*, respectively, allow downhole casing guide member 10 to utilize the inner surface of conductor casing 5 to facilitate guiding casing strings 7*a* and 7*b*, respectively, downhole. Moreover, the use of the inner surface of conductor casing 5 allows the diameter of casing strings 7*a* and 7*b* to be maximized by eliminating any material or wall which would space casing strings 7*a* and 7*b* from the inner surface of conductor casing 5.

As can be appreciated, said first bore, having a portion thereof bounded by the interior surface of conductor casing 5, is capable of guiding therethrough casing string 7*a* wherein casing string 7*a* may have an outer diameter of slightly less than D1 or less to permit annular clearance of first casing string 7*a* within said first bore. Likewise, said second bore, having a portion thereof bounded by the interior surface of conductor casing 5, is capable of guiding therethrough casing string 7*b* wherein casing string 7*b* may have an outer diameter of slightly less than D2 or less to permit annular clearance of second casing string 7*b*. In the preferred embodiment, diameter D1 and D2 are equal.

As can be readily seen, said first bore and said second bore have distorted circular profiles in a plane perpendicular to the center axis of conductor casing 5. When first and second casing strings 7*a* and 7*b* are run through their respective bores, a gap exists on each side of first casing string 7*a* and on each side of second casing string 7*b*. Thereby, the contour of first concaved surface 25*a* provides first and second passageways 31*a* and 31*a*' when first casing string 7*a* is journalled in said first bore for permitting fluid (such as, without limitation, drilling fluids and cement slurries) flow therethrough. Likewise, the contour of second concaved surface 25*b* provides first and second passageways 31*b* and 31*b*' when second casing string 7*b* is run through said second bore for permitting fluid flow therethrough.

While said first bore and said second bore each have a distorted circular profile, the profiles do not compromise the necessary annular clearance for running therethrough first and second casing strings 7*a* and 7*b*, respectively. Moreover, the distorted circular profile of said first bore and said second bore provides a sufficient annular clearance which does not allow first casing string 7*a* and second casing string 7*b*, respectively, to roll side-to-side by any significant amount therein, when first and second casing strings 7*a* and 7*b* are maximized to D1 and D2, respectively, while providing passageways for the flow of drilling fluids and/or cement slurries.

The contour of first and second concaved surfaces 25*a* and 25*b* form first wedged shaped region A on one end of elongated center spacing member 23 and second wedged shaped region B on the other end of elongated center spacing member 23 wherein midpoints P3 and P4 of the arc defined by first and second wedged shaped regions A and B, respectively, are circumferentially spaced 180° apart. Structure 20 is not solid in first and second wedge shaped regions A and B. Instead, first and second wedged shaped regions A and B have formed therein first and second passages 40*a* and 40*b*, respectively. Since wedged shaped regions A and B are identical only one such wedged shaped region will be described in detail.

In the preferred embodiment, first passage 40*a* is generally trapezodially-shaped. Nevertheless, any geometrical shape may be substituted provided fluid flow is not significantly compromised. Trapezodially-shaped first passage 40*a*, formed in wedge shaped region A is defined by first and second linearly sloping surface walls 41*a* and 41*b* and surface wall 42. First and second linearly sloping surface walls 41*a* and 41*b* slope inwardly from circumference C to surface wall 42.

First and second linearly sloping surface walls 41*a* and 41*b* complete the contour of the first pair of radial leg support members 21*a* and 21*b* which radially project angularly in different directions from elongated center spacing member 23 and are bounded by circumference C. In other words, the exterior side surface wall of the first pair of radial leg support members 21*a* and 21*b* is curved and the interior side surface wall is linearly sloped.

In the preferred embodiment, top surface 47 and the bottom surface 47' of radial leg support members 21*a*, 21*b*, 22*a*, and 22*b* of structure 20 are beveled to the distal ends thereof, forming shoulders 60, to facilitate the upward and downward movement of downhole casing guide member 10 downhole in conductor casing 5.

Each end portion 23*a* and 23*b* of elongated center spacing member 23 is flared as a result of the curvature of first and second concaved surfaces 25*a* and 25*b*. End portion 23*a* of elongated center spacing member 23 has formed therein arch-shaped cavity 27*a*. Arch-shaped cavity 27*a* may be semicircular or any other desirable arch shape. Similarly, end portion 23*b* of elongated center spacing member 23 has formed therein arch-shaped cavity 27*b*, which may be semicircular or any other desirable arch shape.

Since first and second clamping bracket members 50*a* and 50*b* are identical, only one will be described in detail. First clamping bracket member 50*a* comprises longitudinal support bar member 51*a* and first and second transverse bars 52*a* and 53*a*. Longitudinal support bar member 51*a* is longitudinally aligned substantially parallel to the center axis of conductor casing 5, thereby presenting minimal obstruction to fluid flow thereby. One end of longitudinal support bar member 51*a* has first transverse bar 52*a* coupled thereto, while the other end of longitudinal support bar member 51 a has second transverse bar 53*a* coupled thereto. Means for fastening first clamping bracket member 50*a* to structure 20 are provided, to fasten first clamping bracket member 50*a* to structure 20 with longitudinal support bar member 51*a* aligned substantially parallel to the center axis of structure 20 (and also of conductor casing 5, as described above). In the preferred embodiment, the means for fastening first clamping bracket member 50*a* to structure 20 comprises a plurality of threaded bolts 45 engaging threaded holes 45*a* in structure 20, with nuts 45*c* made up on bolts 45 and holding first clamping bracket member 50*a* securely to structure 20. Other fastening means well known in the art may also be used. In the preferred embodiment, first clamping bracket member 50*a* is formed from a integral construction of longitudinal support bar member 51*a* and first and second transverse bars 52*a* and 53*a* of metal alloys, by casting or forging. However, it is understood that first clamping bracket member and first and second transverse bars 52*a* and 53*a* may also be made of separate pieces joined by welding or other suitable means.

Figure 2:
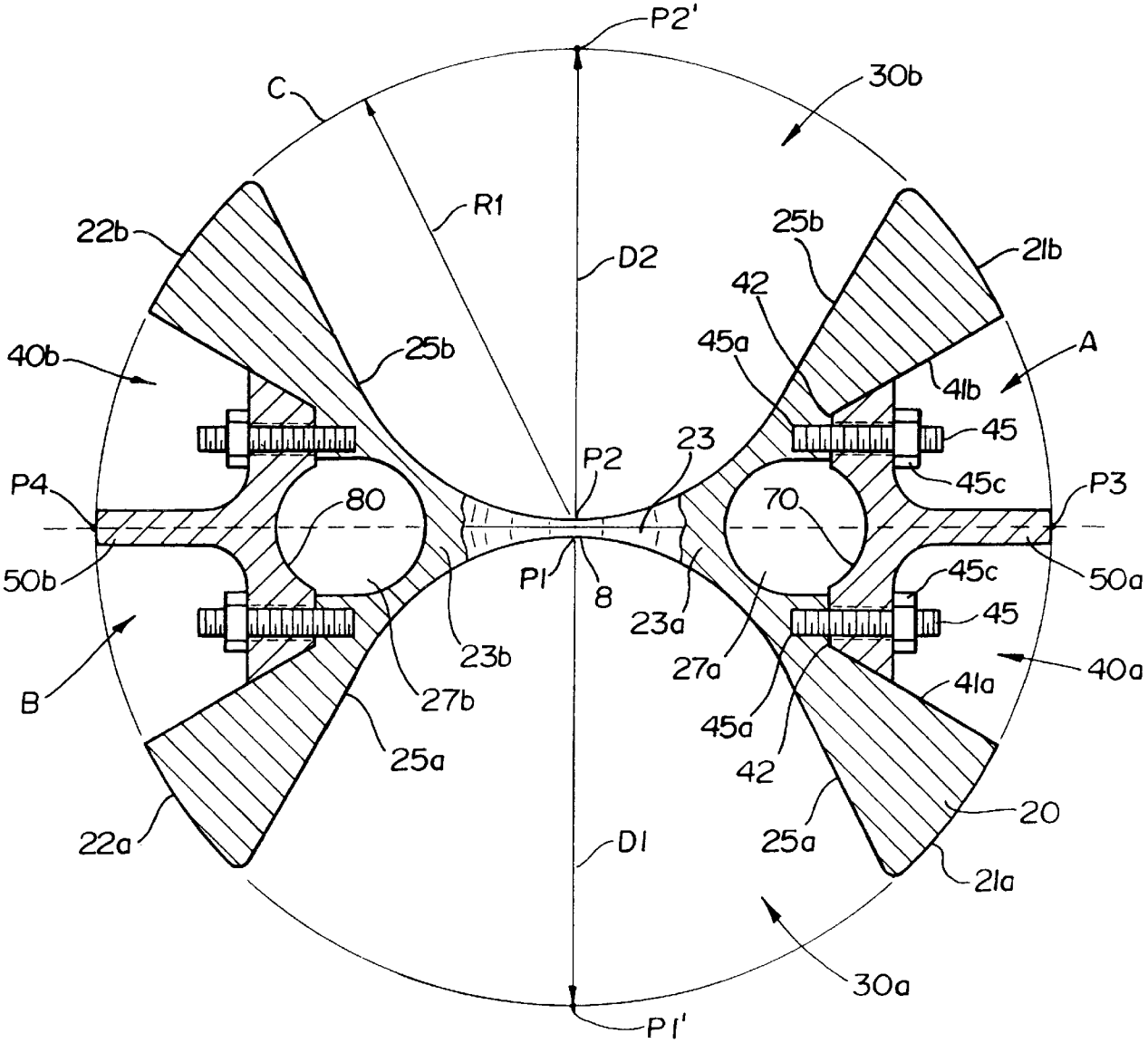
FIG. 2 is a top view of the downhole casing guide member of the present invention.
Figure 3:
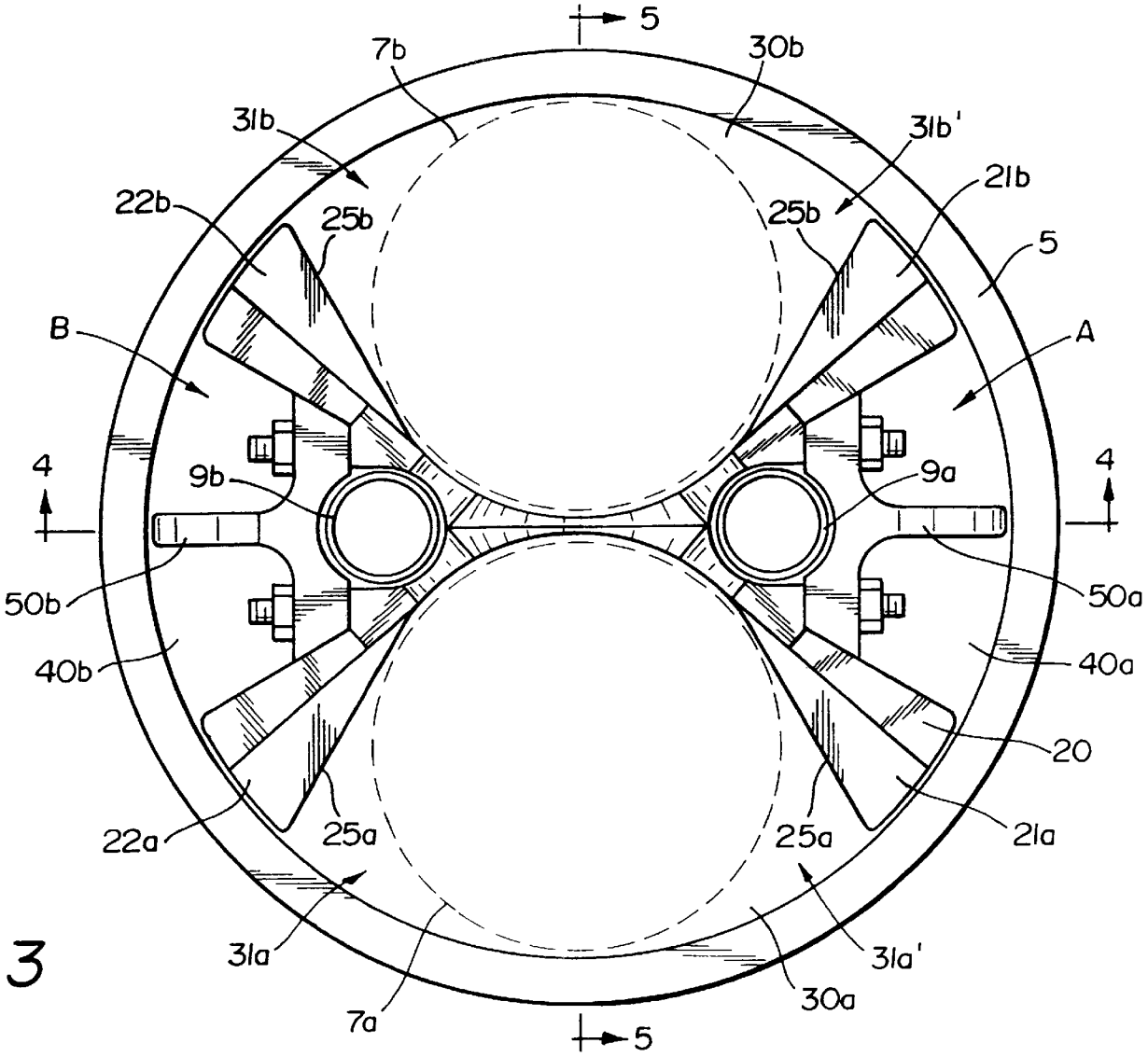
FIG. 3 is a top view of the downhole casing guide member installed in a conductor casing and having the first and second casing strings received within the two bores and the two tubular members clamped to the downhole casing guide member.
Figure 4:
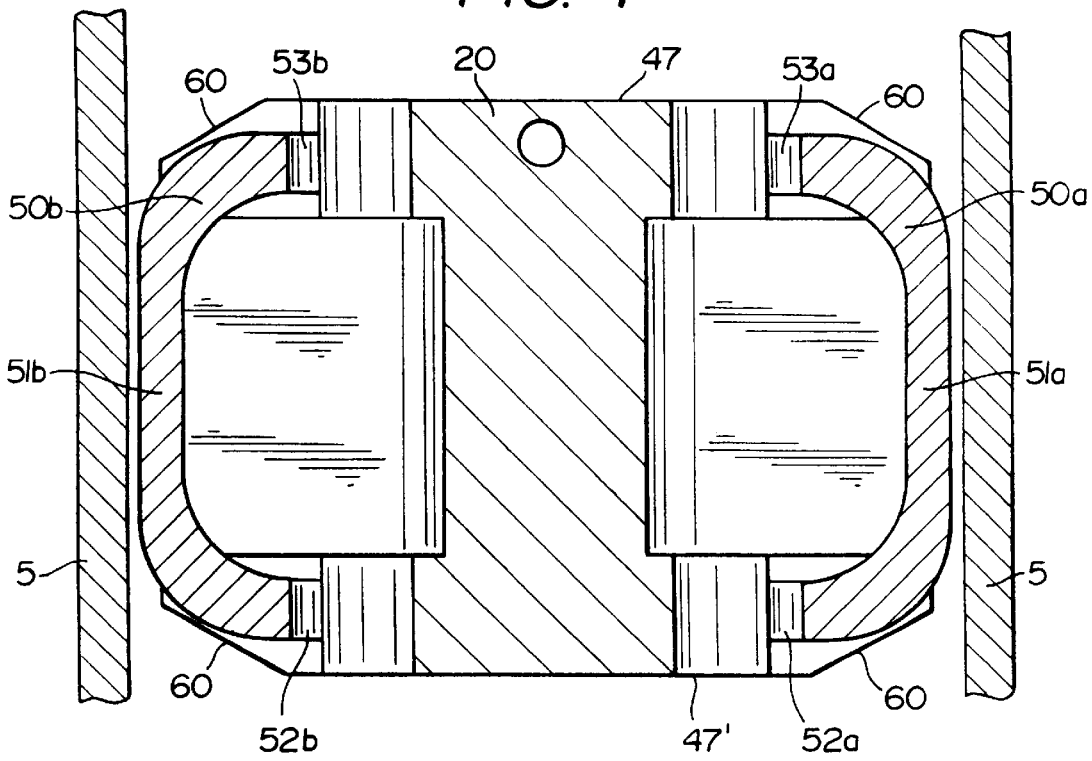
FIG. 4 is a sectional view along the plane of 4—4 of FIG. 31
Figure 5:
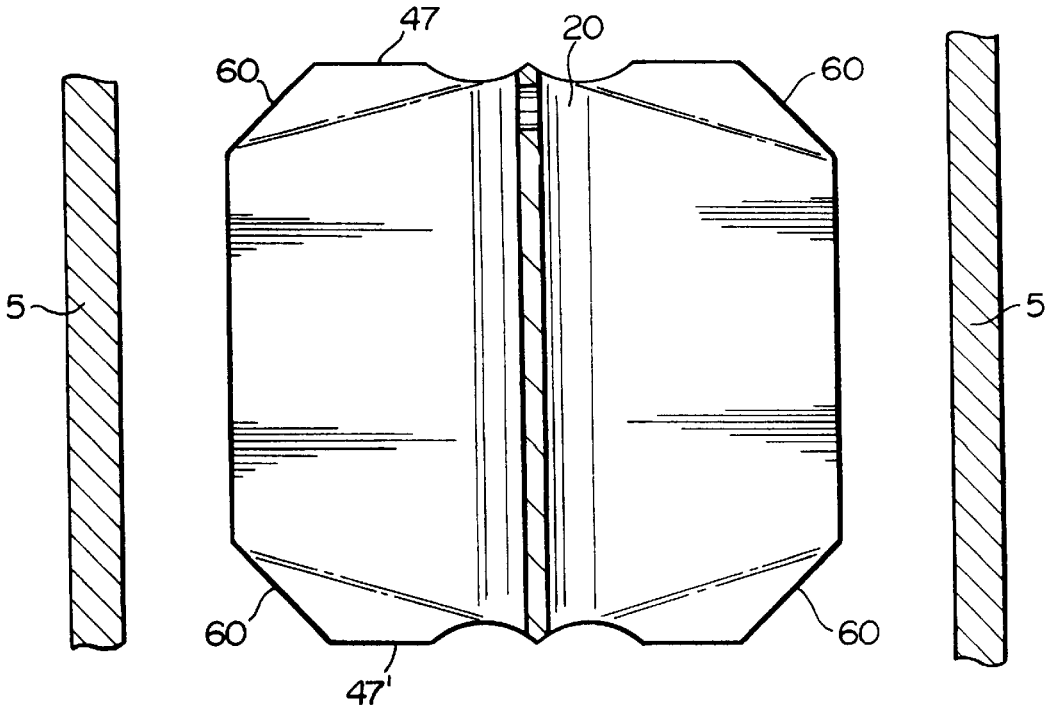
FIG. 5 is a sectional view along the plane of 5—5 of FIG. 3.

First and second transverse bars 52*a* and 53*b*, as may be clearly seen in FIGS. 1, 2, and 3, comprise a generally half-circle cutout 70 which is disposed substantially opposite cavity 27*a* in structure 20. Together, cutout 70 and cavity 27*a* comprise a circular area when first clamping bracket member 50*a* is attached to structure 20, providing a location for placing a tubular member 9*a* in said circular area and clamping structure 20 to tubular member 9*a*, as will be later described.

Second clamping bracket member 50*b* is of like construction to 50*a*. First and second transverse bars 52*b* and 53*b*, as may be seen in FIG. 4, comprise a generally half-circle cutout 80 which is disposed substantially opposite cavity 27*b* in structure 20. Together, cutout 80 and cavity 27*b* comprise a circular area when second clamping bracket member 50*b* is attached to structure 20, providing a location for placing a tubular member 9*b* in said circular area and clamping structure 20 to tubular member 9*b*, as will be later described. As described above, second clamping bracket member 50*b* is attached to structure 20 by bolts or other like means, well known in the art.

In the preferred embodiment, longitudinal support bar members 51*a* and 51*b* are an elongated arch-shaped in profile, bringing the outer extremities of longitudinal support bar members 51*a* and 51*b* substantially to circumference C. Thereby, longitudinal support bar members 51*a* and 51*b* provide added support for structure 20 by bearing against the inner wall of conductor casing 5.

Although many different materials and method of manufacture may be used to form structure 20 and clamping bracket members 50*a* and 50*b*, in one embodiment ductile iron is used. Furthermore, forming structure 20 in unitary fashion, such as by casting, produces a structure having high strength and minimum mass and consequently volume. However, it is understood that other materials may be used to form structure 20 and clamping bracket members 50*a* and 50*b*: other ferrous materials; non-ferrous materials, such as aluminum, zinc, and/or bronze alloys; and non-metallic materials such as plastics or fiber-reinforced composites. Other methods of manufacture of structure 20 and clamping bracket members 50*a* and 50*b*, depending upon material, could be molding, forging, welding together of subcomponents, or other methods known in the art.

Figure 6:
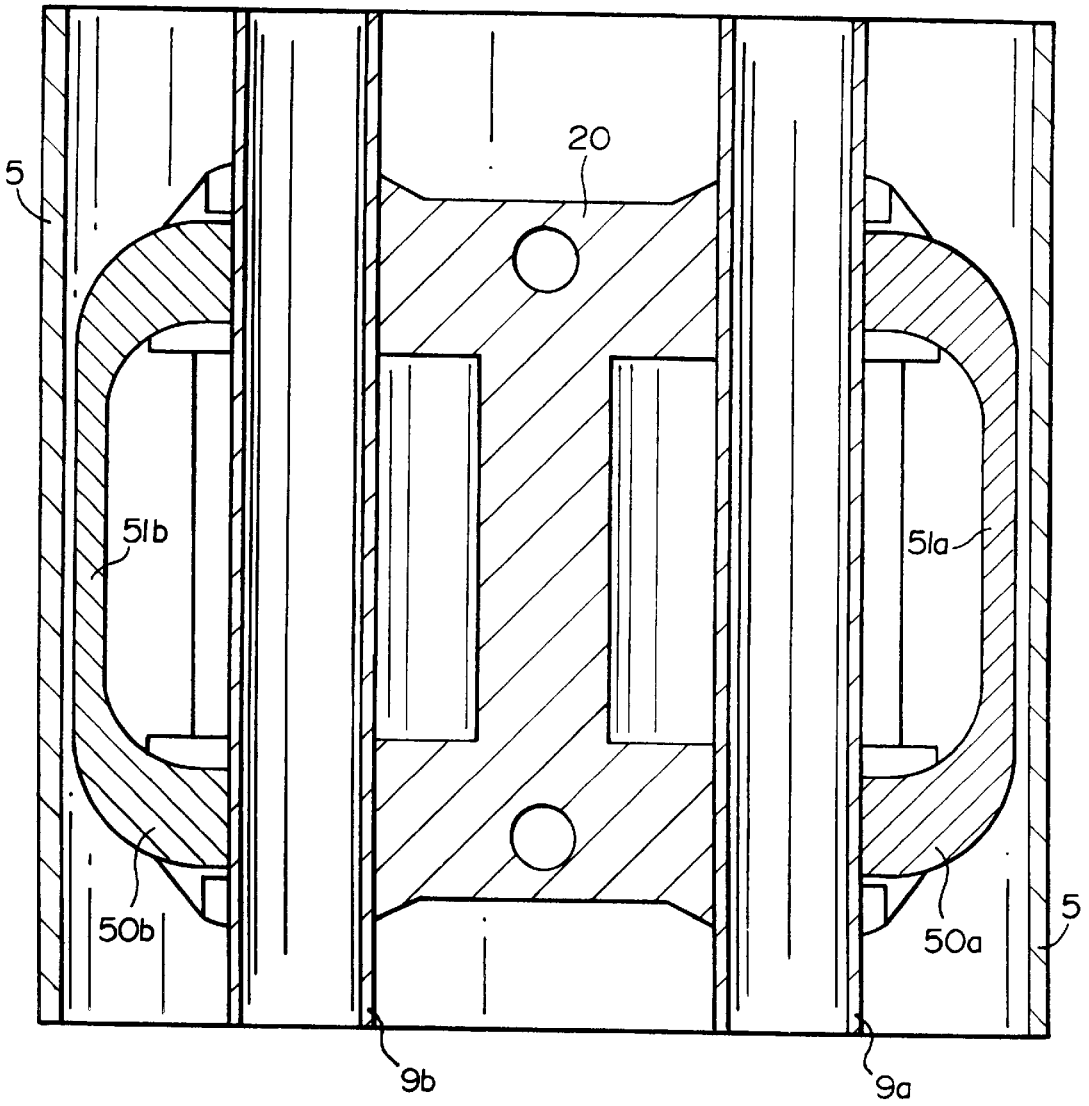
FIG. 6 is a sectional view of FIG. 4, with running strings in place.
Figure 7:
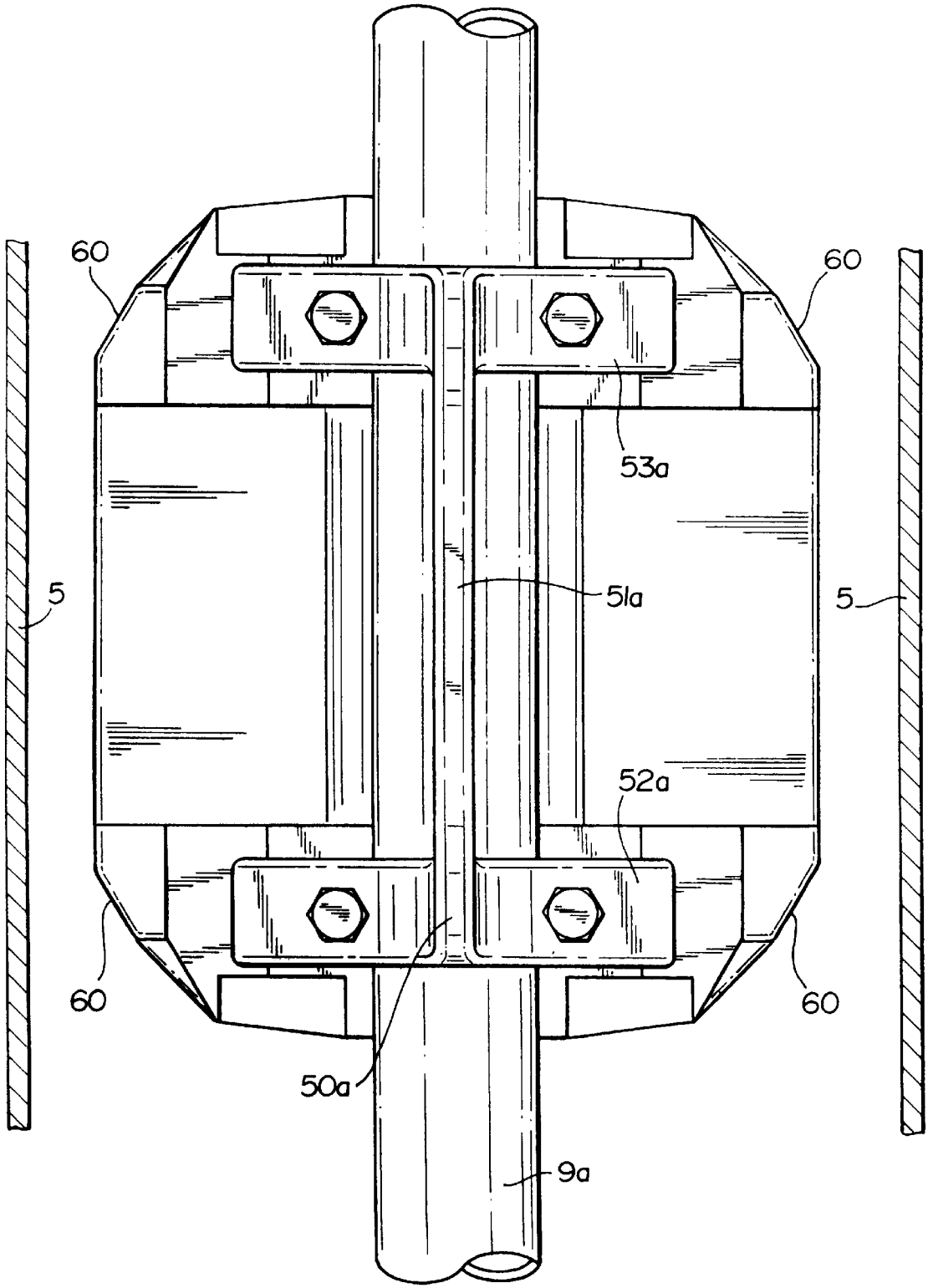
FIG. 7 is a sectional view of FIG. 5, with running strings in place.
Figure 8:
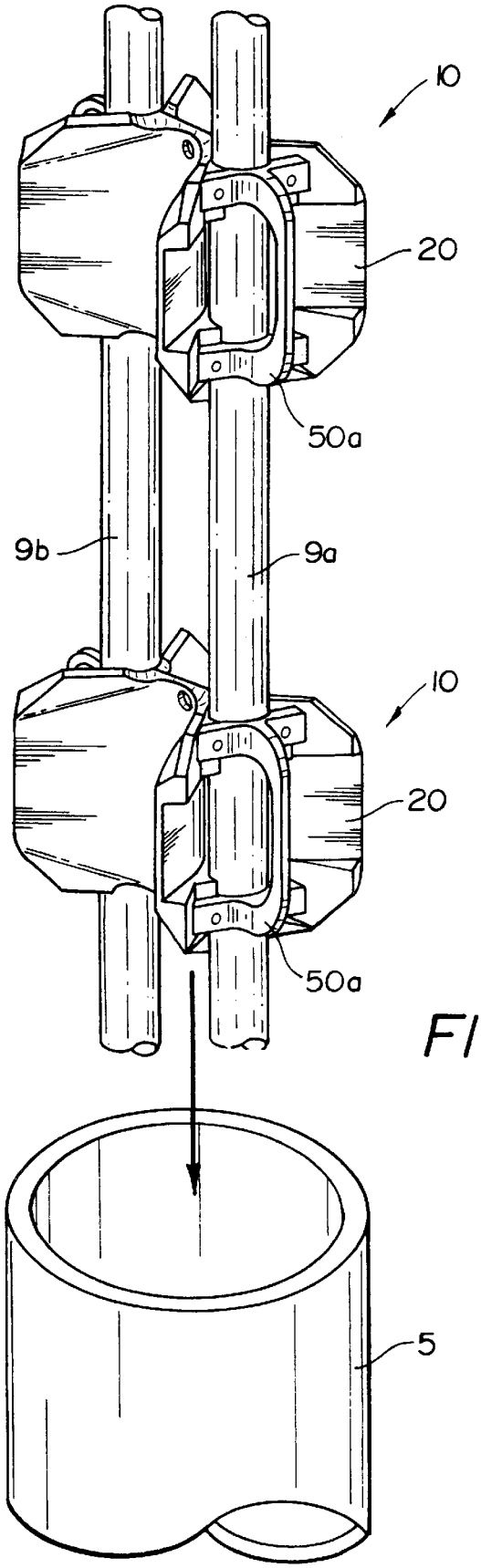
FIG. 8 is a perspective view of a plurality of downhole casing guide members of the present invention, being run into a conductor casing for placement therein.

One method of use of the apparatus of the present invention is now described. With reference to FIGS. 6, 7, and 8, tubular member 9*a*, which may be casing, tubing or drill pipe having a diameter of approximately 5" in an exemplary embodiment, is affixedly secured in arch-shaped cavity 27*a* via first and second transverse bars 52*a* and 53*a* of first clamping bracket member 50*a*. Tubular member 9*b* is affixedly secured in arch-shaped cavity 27*b* via first and second transverse bars 52*b* and 53*b* (only 53*b* shown) of second clamping bracket member 50*b*. The addition of arch-shaped cavities 27*a* and 27*b* for securing therein tubular members 9*a* and 9*b* provide a sufficient amount of unoccupied space in first and second passages 40*a* and 40*b* to allow fluids to flow through first and second passages 40*a* and 40*b*. While the preferred embodiment utilizes two tubular members to lower downhole casing guide member 10, it is understood that in alternative embodiments only one such tubular member may be used.

Thereafter, as illustrated in FIG. 8, a first (and ultimately deepest-set) downhole casing guide member 10 is lowered into conductor casing 5. Once a predetermined spacing has been reached, another downhole casing guide member 10 is clamped to first and second tubular members 9*a* and 9*b*. The assembly is then continued to be lowered into conductor casing 5, installing downhole casing guide members 10 at predetermined spacings, which in the exemplary embodiment may be every 100 to 150 feet, until the bottommost downhole casing guide member 10 is at a desired depth within conductor casing 5. For example, the lowermost downhole guide member 10 may be lowered to the seat (not shown) in the lower portion of primary conductor casing 5. Thus, in a 1000' conductor casing, approximately ten downhole casing guide members 10 will be employed. First and second tubular members 9*a* and 9*b* may also serve to suspend downhole casing guide member 10 within primary conductor casing 5.

Next, a drilling assembly is lowered down one of the conduits thus formed in conductor casing 5, and a wellbore is drilled (having a diameter sufficient for the surface casing to be run) down to the desired surface casing setting depth. A first casing string 7*a* is then run to its setting depth and cemented in place. The second wellbore is then drilled in the remaining conduit, and a second casing string 7*b* is run and cemented in place.

A slightly different sequence of operations may also be followed. After the assembly of downhole guide members 10 is in place within conductor casing 5, when forming the first well of the multiple wells, first casing string 7*a* is lowered downhole to a depth sufficient to place first casing string 7*a* within the lowermost downhole casing guide member 10. Thereafter, a drillstring is run down first casing string 7*a* and drilling and/or under reaming is carried out to a desired casing running depth for first casing string 7*a*. The drillstring is removed, and first casing string 7*a* is lowered to said desired casing running depth and cemented in place. A similar process is carried out for second casing string 7*b*. Once casing strings 7*a* and 7*b* are cemented in place, drilling of the remainder of each well proceeds in generally conventional manner, well known in the art.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

We claim:

1. A downhole casing guide member comprising:

a structure having a unitary formation wherein in a plane perpendicular to a center longitudinal axis of said structure, said unitary formation is generally "Y" shaped in two opposite directions about said center longitudinal axis; and at least one clamping bracket member securable to said structure.

2. The downhole casing guide member of claim 1, wherein said structure comprises:

an elongated center spacing member having first and second flared ends wherein the elongation of said elongated center spacing member is in a plane perpendicular to said center axis of said structure;

a first pair of first and second radial leg support members wherein the first and second radial leg support members of the first pair radially flare angularly in different directions from said first flared end of said elongated center spacing member;

a second pair of first and second radial leg support members wherein the first and second radial leg support members of the second pair radially flare angularly in different directions from said second flared end of said elongated center spacing member; and wherein first and second concaved surfaces form said elongated center spacing member and the exterior surface of the first radial leg support members of the first pair and the second pair and the second radial leg support members of the first pair and the second pair, respectively.

3. The downhole casing guide member of claim 2, wherein the gap between said first and second radial leg support members of said first pair forms a first passage and the gap between said first and second radial leg support members of said second pair forms a second passage.

4. The downhole casing guide member of claim 3, wherein said at least one clamping bracket member comprises a first clamping bracket member and a second clamping bracket member and wherein said first clamping bracket member is receivable in said first passage for securing to said structure and said second clamping bracket member is receivable in said second passage for securing to said structure.

5. The downhole casing guide member of claim 4, wherein each clamping bracket member of said first and second clamping bracket members comprises:

a longitudinal support bar member;

a first transverse bar coupled to one end of said longitudinal support bar member and securable to said structure in close proximity to a top surface of said structure;

a second transverse bar coupled to one end of said longitudinal support bar member and securable to said structure in close proximity to a bottom surface of said structure.

6. The downhole casing guide member of claim 5, wherein each flared end of said first and second flared ends of said elongated center spacing member has formed therein an arch-shaped cavity for receiving therein a respective tubular member.

7. The downhole casing guide member of claim 6, wherein said first and second transverse bars each further comprise an arch-shaped recess positioned substantially opposing said cavity in said passage, for receiving therein a tubular member; and means for securing said first clamping member and said second clamping member to said structure.

8. The downhole casing guide member of claim 2, wherein said first concaved surface forms a first conduit and said second concaved surface forms a second conduit.

9. The downhole casing guide member of claim 8, wherein said structure is receivable in a conductor casing having a center axis parallel to said center axis of said structure wherein an interior surface of said primary conductor casing between the first radial leg support member of the first pair and the first radial leg support member of said second pair and said first conduit form a first bore for guiding therethrough a first casing string; and wherein the interior surface of said primary conductor casing between the second radial leg support member of the first pair and the second radial leg support member of said second pair and said second conduit form a second bore for guiding therethrough a second casing string.

10. The downhole casing guide member of claim 2, wherein at least a portion of a top surface and a bottom surface of said first pair of said first and second radial leg support members and said second pair of said first and second radial leg support members have beveled ends in close proximity to an outer perimeter of said structure.

11. The downhole casing guide member of claim 5, wherein said first flared end of said elongated center spacing member has formed therein a first arch-shaped cavity for receiving therein a first tubular member, wherein said first and second transverse bars each further comprise an arch-shaped recess positioned substantially opposing said cavity in said passage, for receiving therein a tubular member, and wherein said arch-shaped recess of said first clamping member and said second clamping member of said first clamping bracket member clampingly embrace said first tubular member and wherein said second flared end of said elongated center spacing member has formed therein a second arch-shaped cavity for receiving therein a second tubular member wherein said arch-shaped recess of said first clamping member and said second clamping member of said second clamping bracket member clampingly embrace said second tubular member.

12. The downhole casing guide member of claim 4, wherein at least a portion of a top surface and a bottom surface of said first pair of said first and second radial leg support members and said second pair of said first and second radial leg support members have beveled ends in close proximity to an outer perimeter of said structure.

13. The downhole casing guide member of claim 12, wherein said structure is integrally formed.

14. The downhole casing guide member of claim 13, wherein said structure is of a ferrous alloy.

15. The downhole casing guide member of claim 14, wherein said ferrous alloy is ductile iron.

16. The downhole casing guide member of claim 13, wherein said structure is of a non-ferrous alloy.

17. The downhole casing guide member of claim 16, wherein said non-ferrous alloy is a zinc alloy.

18. The downhole casing guide member of claim 13, wherein said structure is of a plastic composite material.

19. A method of controlled placement of multiple casing strings within a larger diameter casing string, comprising the steps of:

a) providing a plurality of downhole casing guide members, each comprising:

a structure having a unitary formation wherein in a plane perpendicular to a center longitudinal axis of said structure, said unitary formation is generally "Y" shaped in two opposite directions about said center longitudinal axis, wherein said structure comprises an elongated center spacing member having first and second flared ends wherein the elongation of said elongated center spacing member is in a plane perpendicular to said center axis of said structure;

a first pair of first and second radial leg support members wherein the first and second radial leg support members of the first pair radially flare angularly in different directions from said first flared end of said elongated center spacing member;

a second pair of first and second radial leg support members wherein the first and second radial leg support members of the second pair radially flare angularly in different direction from said second flared end of said elongated center spacing member; and wherein first and second concaved surfaces form said elongated center spacing member and the exterior surface of the first radial leg support members of the first pair and the second pair and the second radial leg support members of the first pair and the second pair, respectively, and wherein the gap between said first and second radial leg support members of said first pair forms a first passage and the gap between said first and second radial leg support members of said second pair forms a second passage; and at least one clamping bracket member securable to said structure, wherein said at least one clamping bracket member comprises a first clamping bracket member and a second clamping bracket member and wherein said first clamping bracket member is receivable in said first passage for securing to said structure and said second clamping bracket member is receivable in said second passage for securing to said structure;

b) attaching a first of said plurality of downhole casing guide members to at least one tubular member running string;

c) lowering said first of said plurality of downhole casing guide members to a desired depth within a conductor casing;

d) attaching at least one additional of said plurality of downhole casing guide members to said at least one tubular member running string;

e) fixing said at least one running string having said downhole casing guide members attached thereto at a desired point in said conductor casing;

f) running a drill string down one bore formed within said conductor casing by said downhole casing guide members and drilling a wellbore to a desired depth;

g) running a casing string to a desired depth within said wellbore;

h) running a drill string down another bore formed within said conductor casing by said downhole casing guide members and drilling a second wellbore to a desired depth; and i) running a second casing string to a desired depth within said wellbore.

20. A method of controlled placement of multiple casing strings within a larger diameter casing string, comprising the steps of:

a) providing a plurality of downhole casing guide members, each comprising:

a structure having a unitary formation wherein in a plane perpendicular to a center longitudinal axis of said structure, said unitary formation is generally "Y" shaped in two opposite directions about said center longitudinal axis, wherein said structure comprises an elongated center spacing member having first and second flared ends wherein the elongation of said elongated center spacing member is in a plane perpendicular to said center axis of said structure;

a first pair of first and second radial leg support members wherein the first and second radial leg support members of the first pair radially flare angularly in different directions from said first flared end of said elongated center spacing member;

a second pair of first and second radial leg support members wherein the first and second radial leg support members of the second pair radially flare angularly in different direction from said second flared end of said elongated center spacing member; and wherein first and second concaved surfaces form said elongated center spacing member and the exterior surface of the first radial leg support members of the first pair and the second pair and the second radial leg support members of the first pair and the second pair, respectively, and wherein the gap between said first and second radial leg support members of said first pair forms a first passage and the gap between said first and second radial leg support members of said second pair forms a second passage; and at least one clamping bracket member securable to said structure, wherein said at least one clamping bracket member comprises a first clamping bracket member and a second clamping bracket member and wherein said first clamping bracket member is receivable in said first passage for securing to said structure and said second clamping bracket member is receivable in said second passage for securing to said structure;

b) attaching a first of said plurality of downhole casing guide members to at least one tubular member running string;

c) lowering said first of said plurality of downhole casing guide members to a desired depth within a conductor casing;

d) attaching at least one additional of said plurality of downhole casing guide members to said at least one tubular member running string;

e) fixing said at least one running string having said downhole casing guide members attached thereto at a desired point in said conductor casing; and f) running at least two casing strings downhole in said conductor casing, each of said at least two casing strings contained within a bore formed by said downhole casing guide members and said conductor casing.

21. A wellbore casing system for drilling multiple wells from within a single conductor casing, comprising:

a) a plurality of downhole casing guide members disposed in spaced apart relation downhole within said conductor casing, each of said downhole guide members clamped to a tubular member running string, each of said plurality of downhole casing guide members comprising:

a structure having a unitary formation wherein in a plane perpendicular to a center longitudinal axis of said structure, said unitary formation is generally "Y" shaped in two opposite directions about said center longitudinal axis, wherein said structure comprises an elongated center spacing member having first and second flared ends wherein the elongation of said elongated center spacing member is in a plane perpendicular to said center axis of said structure;

a first pair of first and second radial leg support members wherein the first and second radial leg support members of the first pair radially flare angularly in different directions from said first flared end of said elongated center spacing member;

a second pair of first and second radial leg support members wherein the first and second radial leg support members of the second pair radially flare angularly in different direction from said second flared end of said elongated center spacing member; and wherein first and second concaved surfaces form said elongated center spacing member and the exterior surface of the first radial leg support members of the first pair and the second pair and the second radial leg support members of the first pair and the second pair, respectively, and wherein the gap between said first and second radial leg support members of said first pair forms a first passage and the gap between said first and second radial leg support members of said second pair forms a second passage; and at least one clamping bracket member securable to said structure, wherein said at least one clamping bracket member comprises a first clamping bracket member and a second clamping bracket member and wherein said first clamping bracket member is receivable in said first passage for securing to said structure and said second clamping bracket member is receivable in said second passage for securing to said structure; and b) a casing string disposed downhole to a desired depth in each of said conduits formed by said structure and the interior wall of said conductor casing.

* * * * *